US007089946B2

(12) United States Patent
Rousselet

(10) Patent No.: US 7,089,946 B2
(45) Date of Patent: Aug. 15, 2006

(54) COSMETIC APPLICATOR

(75) Inventor: Guilhem Rousselet, Saint Maur des Fosses (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/926,095

(22) Filed: Aug. 26, 2004

(65) Prior Publication Data

US 2005/0066990 A1 Mar. 31, 2005

Related U.S. Application Data

(60) Provisional application No. 60/501,822, filed on Sep. 11, 2003.

(30) Foreign Application Priority Data

Aug. 29, 2003 (FR) ..... 03 10293

(51) Int. Cl.
*A45D 40/26* (2006.01)

(52) U.S. Cl. ..... 132/218; 15/206

(58) Field of Classification Search ..... 132/218, 132/216; 401/122–129; 15/206; 3/18
See application file for complete search history.

(56) References Cited

U.S. PATENT DOCUMENTS 2,148,736 A * 2/1939 Engel, Jr. ..... 401/129
4,108,162 A * 8/1978 Chikashige et al. ..... 600/569
4,733,425 A * 3/1988 Hartel et al. ..... 15/206
4,898,193 A * 2/1990 Gueret ..... 132/218
5,238,011 A * 8/1993 Gueret ..... 132/218
5,567,072 A * 10/1996 Dunleavy et al. ..... 401/129
6,227,735 B1 5/2001 Gueret
6,305,862 B1 * 10/2001 Gueret ..... 401/122
6,408,857 B1 6/2002 Neuner
6,481,445 B1 * 11/2002 Miraglia ..... 132/218
2003/0172485 A1 * 9/2003 Dumler et al. ..... 15/206

* cited by examiner

*Primary Examiner*—Todd E. Manahan
*Assistant Examiner*—Rachel Running
(74) *Attorney, Agent, or Firm*—Oblon, Spivak, McClelland, Maier & Neustadt, P.C.

(57) ABSTRACT

An applicator is disclosed that is particularly advantageous for cosmetics such as mascara. The applicator includes a twisted core having: a first portion in which are trapped bristles arranged in a radial manner relative to the core, and a second portion fixed in a rod, with the second portion of the core being formed by at least two twisted zones having a different direction and/or pitch. A container or packaging arrangement including such an applicator is also disclosed.

40 Claims, 3 Drawing Sheets

COSMETIC APPLICATOR

CROSS REFERENCE TO RELATED APPLICATIONS

This document claims priority to French Application No. 03 10293, filed Aug. 29, 2003 and U.S. Provisional Application No. 60/501,822, filed Sep. 11, 2003, the entire contents of which are hereby incorporated by reference.

FIELD OF THE INVENTION

The invention relates to an applicator for a cosmetic product. The invention is particularly advantageous as an applicator for eye make-up such as mascara, to apply the mascara to eyelashes and eyebrows.

BACKGROUND OF THE INVENTION

Discussion of Background

In the field of mascara, the most commonly used applicators are formed from so-called "twisted" brushes. Such twisted brushes are made by placing a layer of bristles between two branches of a steel wire configured in the shape of a hairpin, then twisting the two branches of the steel wire about its axis. The steel wire thus twisted forms a spiral (actually, one spiral or helix for each strand of steel wire) in which the turns rise from left to right in relation to the direction of twist of the steel wire (when the brush is viewed in a vertical position) or from right to left. The first type of twisting produces a brush sometimes referred to as a "left-handed brush". Such a brush is described in patent EP 0 611 170. The second type of twisting, hitherto the most frequently encountered, produces a brush referred to as a "right-handed brush".

Such twisted brushes generally include a "bristled" part defining an applicator portion, extending into a "non-bristled" part of the steel wire, sometimes referred to as the "tail" of the brush. The non-bristled part serves to fix the device to a rod attached to an element used to grasp the device, with the element also providing a closure cap for the bottle containing the mascara.

The brush should be attached to the rod so that the brush does not axially fall out of the rod and is not thereby rendered unusable. The brush attachment should also have considerable rotational restraint so that the brush turns with the rod when the rod is rotated by the user to unscrew the cap from the bottle. The attachment must be especially firm when the mascaras used are mascaras that dry very quickly, i.e. mascaras having a relatively thick formulation and which therefore adhere strongly to the brush and to the bottle.

To attach the brush to the rod, the tail end of the brush is generally inserted into a hole fashioned in the rod, with the diameters of this hole and the tail of the brush being substantially equal. The attachment is secured by heating the metal tail of the brush and forcing it into the hole in the rod so that the plastic material of the rod melts locally in contact with the tail of the brush and conforms to the shape of the twist in the tail of the brush.

The brush is therefore securely restrained in that the rod, by conforming to the shape of the twist, forms a kind of female thread around the tail of the brush which constitutes a male thread. Thus, any axial movement becomes impossible without deforming the material of the rod or the brush. However, rotation in the direction tending to unscrew the tail from the brush remains easy in that there is no chemical adhesion between the plastic and the metal, and in that this movement involves no mechanical deformation. Thus, the rotational restraint remains low. The unscrewing movement of the brush relative to the rod can occur in the direction of opening or closing of the mascara.

To address this problem, a conventional approach is to locally crush the tail of the brush so as to render it locally flat and thus prevent the tail of the brush from unscrewing during the rotational movement. However, this flattening is only effective at fairly low rotational torque values, and is not sufficiently effective for mascaras of relatively thick consistency.

SUMMARY OF THE INVENTION

One of the objects of the invention is therefore to provide a cosmetic applicator that does not present the drawbacks of the prior art.

According to one object of the invention, an applicator is provided in which the brush has minimal or no risk of separating from the rod to which it is attached, even with products of relatively sticky consistency.

A further object of the invention is to provide an applicator which can be made in a simple manner and at a low cost.

According to the invention, these objects can be achieved, wholly or partially, by a cosmetic applicator, e.g., for mascara, with a twisted core which includes a first portion in which are trapped bristles arranged in a radial manner relative to the core, and a second portion fixed in a rod, with the second portion of the core being formed by at least two twisted zones of different direction and/or pitch. Various alternative features are possible in accordance with the invention.

By way of example, the twisted zone of the second portion of the core contiguous with the bristled portion can be twisted in the same direction as the bristled portion. Also, by way of example, the twisted zone of the second portion of the core contiguous with the bristled portion can be twisted with the same pitch as the bristled portion.

Further by way of example, the second portion of the core can be formed by a twisted zone with a first pitch and by a twisted zone with a second pitch different from the first.

Alternatively, the second portion of the core can be formed by a twisted zone having a progressively increasing, or decreasing, pitch between a first end of the second portion contiguous with the bristled portion of the core and a second end opposite the first.

By way of example, the core can be formed from two branches of a steel wire.

The bristled portion of the core can present a plurality of turns rising from left to right when the applicator is viewed in the vertical position. In this case, the brush is described as "left-handed". Alternatively, the bristled portion of the core can present a plurality of turns rising from right to left when the applicator is viewed face on in the vertical position. In this case, the brush is described as "right-handed".

Also, by way of example, the bristled portion of the core can be straight or rectilinear, or alternatively, curved. The rod can be integral with a grasping element. In addition, the bristles can form a brush of circular or polygonal transverse cross-section, for example, triangular, square or pentagonal.

One or more of the objects of the invention can also be achieved by a device for packaging and applying a product to keratinic fibers, such as the eyelashes or the eyebrows. The device includes a container holding the product, with the container delineating an opening in proximity to which is preferably disposed a wiper element, with the device equipped with an applicator as described above and described further herein.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
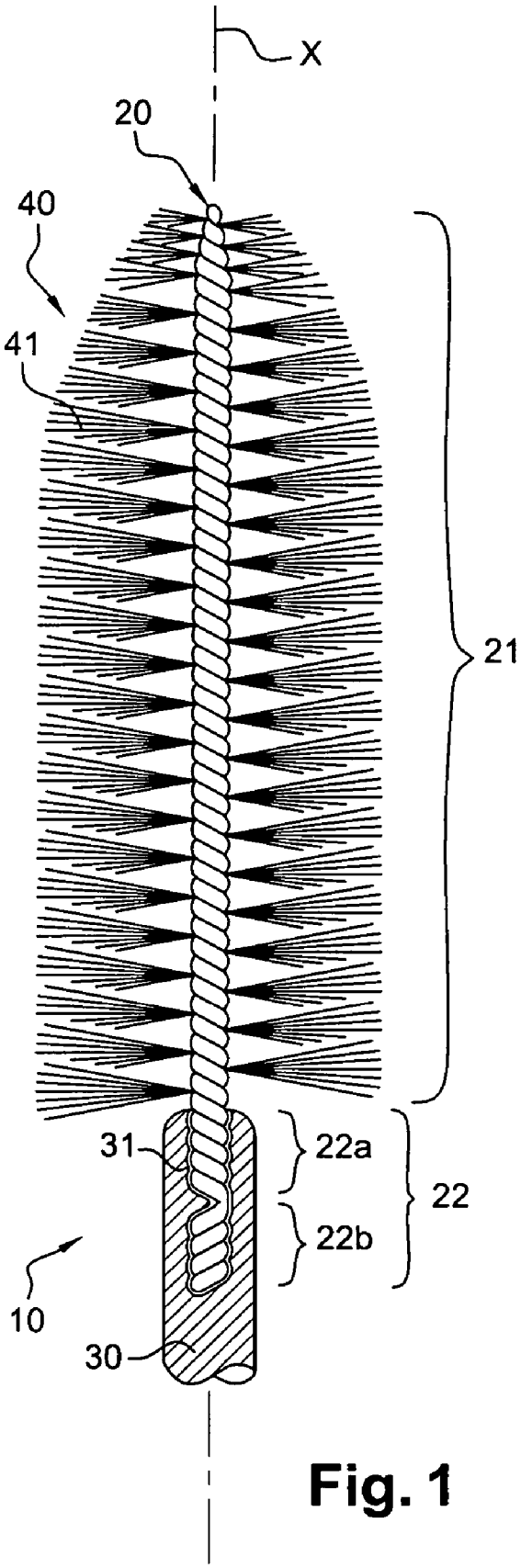
FIG. 1 illustrates a partial sectional view of a first embodiment of an applicator according to the invention.

The applicator device 10 illustrated by way of example in FIG. 1 is designed to apply mascara. The device 10 includes a rod 30 carrying a brush 40. In the illustrated example, the rod extends along an axis X. The brush has a circular cross-section, for example, extending transverse relative to the axis X.

The brush 40 includes a substantially straight twisted core 20. The twisted core is obtained, for example, from a steel wire folded into a U shape, between the branches of which a sheet of bristles 41 is inserted before completing the twist operation. In response to the twisting movement, the bristles 41 are drawn in a spiral configuration to form a succession of turns spaced more or less widely apart. The bristles 41 in the illustrated example extend radially in relation to the support and are substantially rectilinear.

The sheet of bristles 41 forming the brush is trapped in a first portion 21 of the core 20. A second portion of the core 22, without bristles and also referred to herein as the tail of the brush, is fixed in the rod 30. The end of the rod 20 opposite the brush 40 is generally connected to an element (shown in FIG. 6) that preferably forms both a grasping element for the brush 40 and a closure element for the container with which the brush is associated.

In this embodiment, the brush 40 is of the "right-hand brush" type, with the turns of the bristled portion 21 of the twisted core 20 rising from right to left when the brush 40 is viewed in the vertical position as shown.

The tail of the brush 22, which is fixed into the rod 30, includes two zones 22*a* and 22*b* twisted in two different directions. A first twisted zone 22*a*, formed in the extension of the bristled portion 21 of the core 20, has the same direction of twist and the same pitch as the bristled portion 21 of the core. A second twisted zone 22*b*, extending beyond the first twisted zone 22*a*, is in this instance twisted in the reverse direction relative to the first twisted zone 22*a* of the tail of the brush.

The tail of the brush can have a length, by way of example, of approximately 2 cm. The two twisted zones at the tail end of the brush and the twisted portion carrying the bristles have a pitch, for example, of approximately 1 mm.

To make this applicator, after inserting the sheet of bristles between the branches of the steel wire folded into a U-shape, the branches of the steel wire are wound in a first direction so as to form the bristled portion 21 of the core 10 and the first twisted zone 22*a* of the tail 22 of the brush. The two wires are then held at approximately 1 cm from the tip of the tail of the brush, and they are wound in the reverse direction so as to produce the second twisted zone 22*b* at the tail end of the brush.

The tail thus obtained is then partially heated and inserted into a hole 31 pre-formed in the rod 30. The plastic material of the rod melts slightly in contact with the tail and takes on the shape of the tail of the brush.

Thus, once the tail end of the brush, i.e. the zones twisted in both directions, has been inserted while hot into the hole in the rod, relative rotational movement of the brush in relation to the rod becomes impossible without severe deformation of the rod, because screwing in one part of the tail imparts an unscrewing action to the other part of the tail of the brush. The brush is thus very securely restrained from rotation relative to the rod. The presence of the twisted zone in the rod also provides effective axial restraint.

Figure 2:
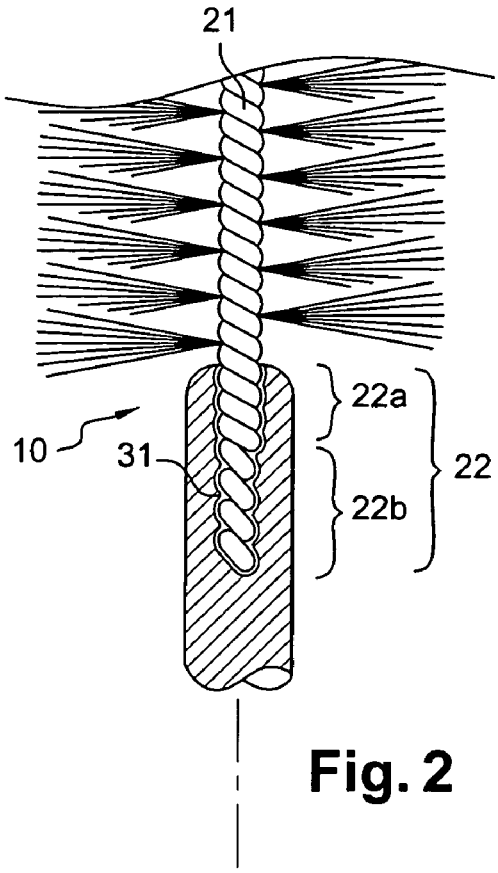
FIG. 2 illustrates a partial sectional view of a second embodiment of an applicator according to the invention.

FIG. 2 illustrates a second embodiment of the applicator 10 according to the invention. In this embodiment, the length of the tail 22 of the brush is twisted in the same direction. However, the tail of the brush includes a first twisted zone 22*a* having a first pitch, for example the same pitch as the bristled portion of the core, and a second twisted zone 22*b* having a different pitch, with this pitch also being constant. The first twisted zone 22*a* of the tail of the brush has a pitch approximately equal to 1 mm, for example, and the second twisted zone 22*b* has a pitch of 1.5 mm, for example.

Figure 3:
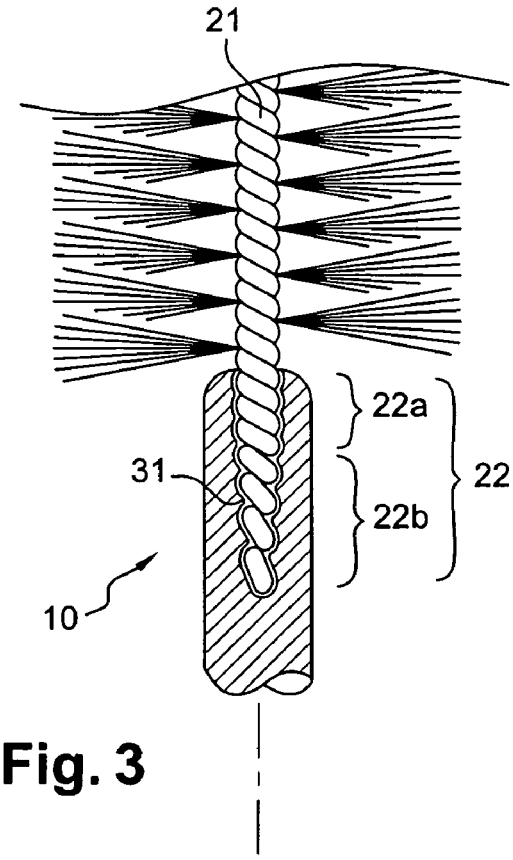
FIG. 3 illustrates a partial sectional view of a third embodiment of an applicator according to the invention.

FIG. 3 illustrates a third embodiment of the applicator 10 according to the invention. In this embodiment, the length of the tail 22 of the brush is also twisted in the same direction. However, the tail 22 of the brush includes a first twisted zone 22*a* having a first pitch, for example the same pitch as the bristled portion of the core. The second twisted zone 22*b* of the tail in this instance has a pitch different from that of the first twisted zone but it is not constant over the full length of this zone. The pitch in this second twisted zone increases progressively from the first twisted zone up to the end of the core. Alternatively, the second twisted zone could decrease progressively from the first twisted zone to the end of the core. As a further alternative, the second portion of the core could include a portion in which the pitch increases and/or decreases progressively, so that the increasing or decreasing pitch provides the two zones with different pitches.

In the latter two embodiments, relative rotational movement of the brush in relation to the rod without severe deformation of the rod is also prevented, because the pitch of the twisted zone at the tail end of the brush is not constant, to thereby prevent unscrewing. Furthermore, the presence of the twisted zone in the rod also provides effective axial restraint. Here again, the brush is held very securely in the rod.

Figure 4:
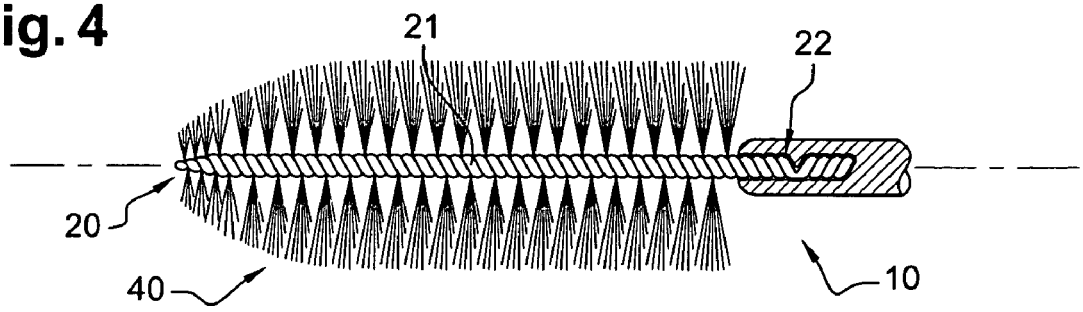
FIGS. 4 and 5 illustrate variants of the applicator depicted in FIG. 1.

FIG. 4 illustrates an alternative embodiment of the applicator depicted in FIG. 1. In this variant, the brush 40 is distinguished from the brush in FIG. 1 in that it is of the "left-hand brush" type, with the turns of the bristled portion 21 of the twisted core rising from left to right when the brush is viewed in the vertical position. With regard to the advantages afforded by a left-hand twisted core, reference may be made to U.S. Pat. No. 6,227,735, the contents of which are incorporated herein by reference.

Figure 5:
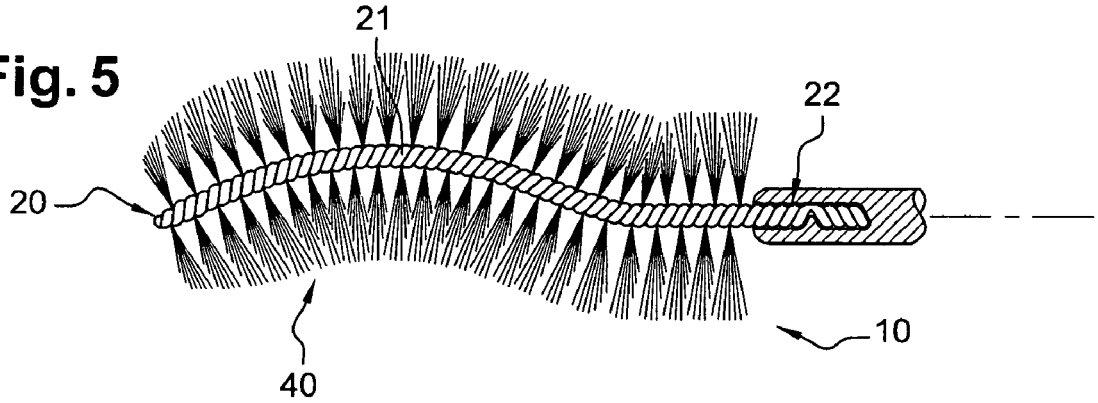

The brush according to the variant in FIG. 5 is distinguished from the brush in FIG. 1 in that the bristled portion 21 of the twisted core 20 is curved, with the curvature corresponding substantially to the curvature of the line of the eyelashes on the eyelid. The tail of the core is preferably still straight.

Figure 6:
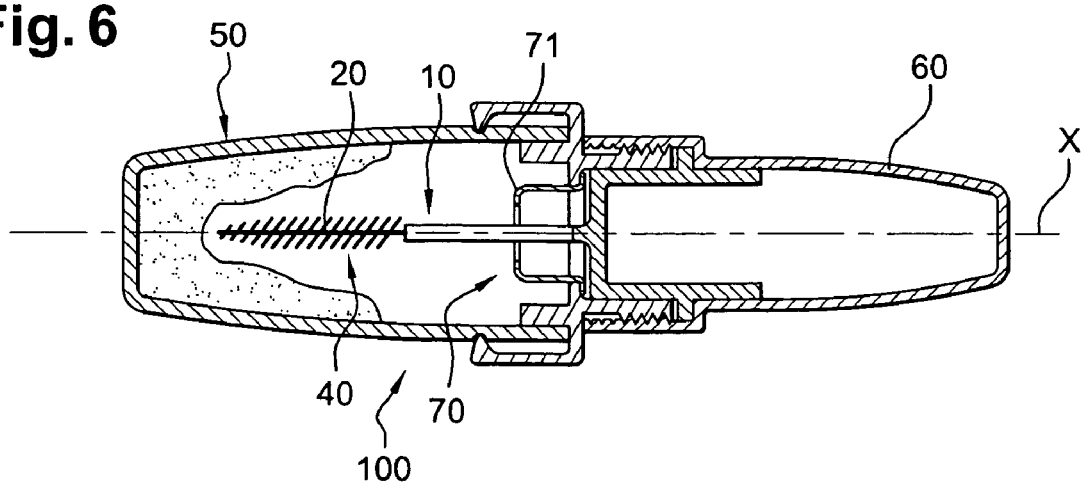
FIG. 6 illustrates a packaging and application device using an applicator according to the invention.

FIG. 6 illustrates a packaging and application device 100 equipped with an applicator device 10 of the type described previously with reference to FIGS. 1 to 5. The device 100 includes a container 50 holding a reserve of a cosmetic product, preferably an eye make-up such as mascara, and an applicator 10. The applicator 10 includes an applicator device of the twisted brush type, preferably attached to the end of a rod 30 extending along axis X. The other end of the rod 30 is integral with a grasping element 60 which also forms a closure cap for the container 50. The container 50 incorporates a wiper element 70 formed, in this instance by way of example, by a cylindrical sleeve of which one end terminates at a flexible annular lip 71. When the applicator 10 is in the mounted position on the container 50, the entire applicator device 10 is preferably located between the wiper lip 71 and the bottom of container. Other types of wiper elements can be used, for example a block of open-cell or semi-open cell foam, traversed axially by a slot or a passage of which the delimiting edges are substantially contiguous when no force is being exerted thereon.

To use the applicator, the user unscrews the cap formed by the grasping element 60 and withdraws the applicator 10 from the container 60. In so doing, the applicator device 10 is caused to pass through the wiper element 70, thereby regulating the quantity of product distributed on the bristles. The withdrawal movement of the applicator is substantially lengthwise relative to the axis X. After use, the user replaces the applicator in the container, again causing the applicator device 10 to pass through the wiper element 70.

In the foregoing detailed description reference is made to preferred embodiments of the invention. It is evident that variants thereto can be proposed without departing from the invention as claimed herebelow. For example, the transverse cross-section of the brush perpendicular to the axis X can be of any shape other than circular, such as polygonal, or for example square, rectangular, triangular, pentagonal, etc. Similarly, the transverse cross-section of the bristles can be of different shapes, and the brush can include bristles having a single type of cross-section, or bristles having a combination of different cross-sections.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A cosmetic applicator for mascara, comprising:

(a) a rod at least partially formed of a plastic material;

(b) a twisted core, said twisted core comprising:

(i) a first portion in which are trapped bristles extending radially relative to the core, wherein said first portion extends outside of said rod; and (ii) a second portion fixed in the plastic material of said rod, wherein the second portion of the core includes at least a first twisted zone and a second twisted zone which extend along a common axis and are each fixed in the plastic material of said rod, and wherein the first twisted zone is twisted in a different direction and/or with a different pitch as compared with the second twisted zone.

2. An applicator according to claim 1, wherein the first twisted zone of the second portion of the core is contiguous with the first portion, and wherein the first twisted zone is twisted in the same direction as the first portion.

3. An applicator according to claim 2, wherein the first twisted zone of the second portion is twisted with the same pitch as the first portion of the core.

4. An applicator according to claim 3, wherein at least one of the first and second twisted zones of the second portion of the core has a pitch which increases progressively in a direction from the first portion of the core toward an end of the core opposite the first portion of the core.

5. An applicator according to claim 3, wherein at least one of the first and second twisted zones of the second portion of the core has a pitch which decreases progressively in a direction from the first portion of the core toward an end of the core opposite the first portion of the core.

6. An applicator according to claim 3, wherein the first twisted zone has a first pitch and the second twisted zone has a second pitch different from the first pitch.

7. An applicator according to claim 6, wherein the first portion of the applicator includes a plurality of turns rising from left to right when the applicator is vertical with the first portion at a top of the applicator.

8. An applicator according to claim 6, wherein the first portion of the applicator includes a plurality of turns rising from right to left when the applicator is vertical with the first portion at a top of the applicator.

9. An applicator according to claim 6, wherein the first twisted zone is twisted in the same direction as the second twisted zone.

10. An applicator according to claim 6, in combination with a container, wherein said container contains a mascara product, and wherein said container delineates an opening and includes a wiper element proximate to said opening.

11. An applicator according to claim 1, wherein the first twisted zone is twisted in the same direction as the second twisted zone.

12. An applicator according to claim 1, wherein the first twisted zone is twisted in a direction opposite to that of the second twisted zone.

13. An applicator according to claim 12, in combination with a container, wherein said container contains a mascara product, and wherein said container delineates an opening and includes a wiper element proximate to said opening.

14. An applicator according to claim 1, wherein the first twisted zone of the second portion is twisted with the same pitch as the first portion of the core.

15. An applicator according to claim 1, wherein the first twisted zone has a first pitch and the second twisted zone has a second pitch different from the first pitch.

16. An applicator according to claim 1, wherein at least one of the first and second twisted zones of the second portion of the core has a pitch which increases progressively in a direction from the first portion of the core toward an end of the core opposite the first portion of the core.

17. An applicator according to claim 1, wherein at least one of the first and second twisted zones of the second portion of the core has a pitch which decreases progressively in a direction from the first portion of the core toward an end of the core opposite the first portion of the core.

18. An applicator according to claim 1, wherein the first twisted zone of the second portion has a constant pitch, and the second twisted zone of the second portion has a pitch which varies.

19. An applicator according to claim 18, in combination with a container, wherein said container contains a mascara product, and wherein said container delineates an opening and includes a wiper element proximate to said opening.

20. An applicator according to claim 18, wherein the first twisted zone is positioned between the first portion and the second twisted zone.

21. An applicator according to claim 20, wherein the first portion of the core is twisted with a pitch which is the same as the constant pitch of the first twisted zone.

22. An applicator according to claim 1, wherein the entire core is formed from two branches of a steel wire.

23. An applicator according to claim 1, wherein the first portion of the applicator includes a plurality of turns rising from left to right when the applicator is vertical with the first portion at a top of the applicator.

24. An applicator according to claim 1, wherein the first portion of the applicator includes a plurality of turns rising from right to left when the applicator is vertical with the first portion at a top of the applicator.

25. An applicator according to claim 1, wherein the first portion of the core is rectilinear.

26. An applicator according to claim 1, wherein the first portion of the core is curved.

27. An applicator according to claim 1, wherein the rod is integral with a grasping element.

28. An applicator according to claim 1, in combination with a container, wherein said container contains a mascara product, and wherein said container delineates an opening and includes a wiper element proximate to said opening.

29. An applicator and container according to claim 28, wherein the rod is associated with a holding element which can be held to apply a product with said applicator, and wherein said holding element also forms a closure element for said container.

30. An assembly for containing and applying a product to keratinic fibers comprising:

a container, said container containing a product;

a closure element which closes said container, wherein at least one part associated with said closure element is formed of a plastic material, and wherein an applicator is associated with said closure element with said applicator coupled to said closure element by way of said plastic material, said applicator including a twisted core comprising:

(i) a first portion having an applicator portion associated therewith; and (ii) a second portion fixed in said plastic material to hold the applicator in position relative to said closure element, said second portion including a first twisted zone and a second twisted zone, wherein said first twisted zone and said second twisted zone extend along a common axis and are each fixed in said plastic material and wherein the first twisted zone is twisted in a different direction and/or with a different pitch as compared with the second twisted zone.

31. An assembly according to claim 30, wherein said closure element includes a rod associated therewith, and wherein said second portion of said applicator is coupled to and disposed inside of said rod.

32. An assembly according to claim 31, wherein the applicator portion includes a plurality of bristles, and wherein said first portion of said core is twisted, and further wherein said bristles are trapped within a series of twists of said first portion.

33. An assembly according to claim 30, wherein said product is an eye make-up product.

34. An assembly according to claim 30, wherein said product is a mascara product.

35. An assembly according to claim 30, wherein the first twisted zone has a constant pitch and the second twisted zone has a pitch which varies.

36. An assembly according to claim 35, wherein the first portion is twisted with a pitch which is the same as the constant pitch of the first twisted zone.

37. An assembly according to claim 30, wherein the first twisted zone is twisted in an opposite direction of the second twisted zone.

38. An assembly according to claim 37, wherein the first portion is twisted with the same pitch and in the same direction as the first twisted zone.

39. An applicator for mascara comprising:

(a) a rod;

(b) a twisted core, said twisted core comprising:

(i) a first portion in which trapped bristles extending radially relative to said core, wherein said first portion extends outside of said rod; and (ii) a second portion wherein said second portion includes at least a first twisted zone and a second twisted zone, and wherein said first and second twisted zones are each fixed in said rod, and wherein said first and second twisted zones extend along a common axis, and wherein said first twisted zone is twisted in a different direction about said common axis and/or with a different pitch along said common axis compared with the second twisted zone.

40. An applicator as recited in claim 39, wherein said rod is formed of a plastic material, wherein said first and second twisted zones are fixed in said plastic material by heat, and wherein said first and second twisted zones cooperate to prevent loosening of said second portion with respect to said rod.

* * * * *